US005539929A

United States Patent [19]

Revson

[11] Patent Number: 5,539,929

[45] Date of Patent: Jul. 30, 1996

[54] CAP WITH SEALABLE COMPARTMENT

[76] Inventor: Rommy H. Revson, 225 E. 57th St., New York, N.Y. 10022

[21] Appl. No.: 258,555

[22] Filed: Jun. 10, 1994

[51] Int. Cl.[6] ..... A42B 1/24

[52] U.S. Cl. ..... 2/195.1; 2/175.1; 2/209.13; 2/247

[58] Field of Search ..... 2/171, 175.1, 195.1, 2/209.11, 209.12, 209.13, 247, 422

[56] References Cited

U.S. PATENT DOCUMENTS 4,312,076 1/1982 Gamm .
4,386,437 6/1983 Fosher .
4,451,935 6/1984 Henschel .
4,610,038 9/1986 Dennard .
5,214,802 6/1993 McCallum ..... 2/209.12
5,233,703 8/1993 Galka .

*Primary Examiner*—Diana Biefeld
*Attorney, Agent, or Firm*—Schweitzer Cornman & Gross

[57] ABSTRACT

A cap has a head covering portion with a compartment on the exterior of the headcover portion aligned with a lower edge thereof. A zipper or other sealing device is provided for the compartment. In a preferred embodiment, the sealing device is located on an overlying layer to the head covering portion, the periphery of which is sealed to the head covering portion to define the compartment.

6 Claims, 2 Drawing Sheets

CAP WITH SEALABLE COMPARTMENT

The present invention relates to an item of wearing apparel and in particular to a cap or similar item of headwear having a built-in pocket or compartment for small items.

BACKGROUND OF THE INVENTION

Various caps and similar head coverings having compartments fabricated therein are known. For example, U.S. Pat. No. 5,233,703 to Galka proposes a piece of headwear having an identification pocket located upon the bottom surface of the brim. The pocket is particularly adapted to accept an identification card or similar flat element.

U.S. Pat. No. 4,451,935 to Henschel discloses a head covering having a pair of pockets located on the side thereof. A pair of side wall elements, one of which includes a flap, defines the first pocket, while the affixation of the edges of the assembly to the cap defines a second open top pocket.

U.S. Pat. No. 4,312,076 to Gam discloses yet another construction in which a pocket is formed along a frontal segment of the cap. The pocket is typically wedge-shaped, the flap being secured along one edge and having sealing means along the other edges.

Despite the existence of such known constructions, there remains a continuing need for a cap structure having a pocket therein which is of an attractive construction, which provides for secure storage of the items placed therein, and which may be economically and efficiently fabricated.

SUMMARY OF THE INVENTION

In accordance with the present invention a cap includes a head covering portion in association with a brim which is journaled to at least a portion of a lower edge of the head covering portion. When the brim extends only from a frontal region of the head covering portion, an elastic band may be provided which serves to constrict the head covering lower edge, and thus the cap, around the head of the wearer. Typically, such a band is located at the rear of the cap. A semi-circular cutout is provided in the head covering portion material directly above the band. An exteriorly-positioned pocket is provided in the rearward portion of the cap, typically in the area of the elastic band if present, and comprises a first pocket wall defined by a portion of the exterior surface of the cap and a second pocket wall formed by an overlying piece of sheet material joined at its periphery to the cap body. An access opening into the pocket is provided, typically through the overlying sheet material, such access opening being adjustably sealable by use of a zipper or other sealing means.

A fuller understanding of the present invention and the features thereof will be accomplished upon consideration of the following detailed description of preferred, but nonetheless illustrative embodiments thereof, when viewed in conjunction with the annexed drawings.

DETAILED DESCRIPTION OF THE INVENTION

Figure 1:
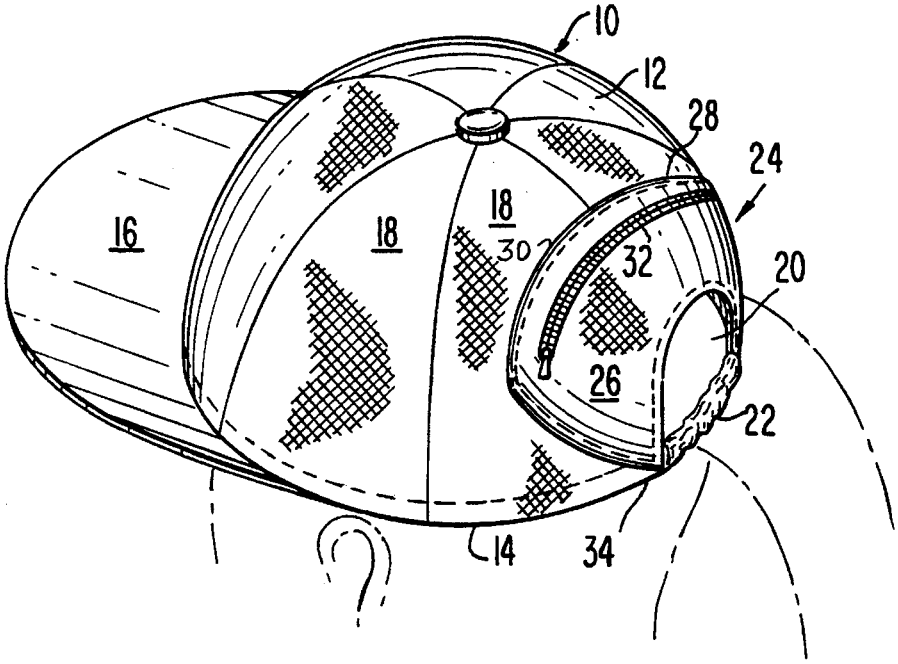
FIG. 1 is a perspective view of a first embodiment of the invention as incorporated into a cap having an elastic band.
Figure 2:
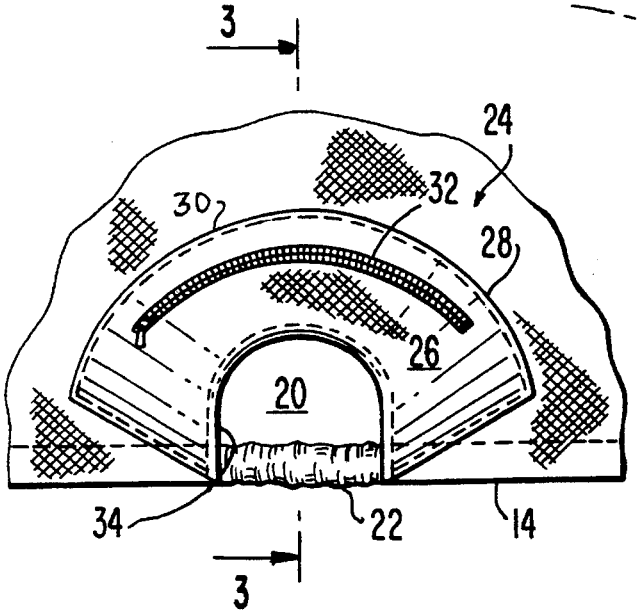
FIG. 2 is an elevation view of the rear portion of the cap of FIG. 1, detailing the pocket therein.
Figure 3:
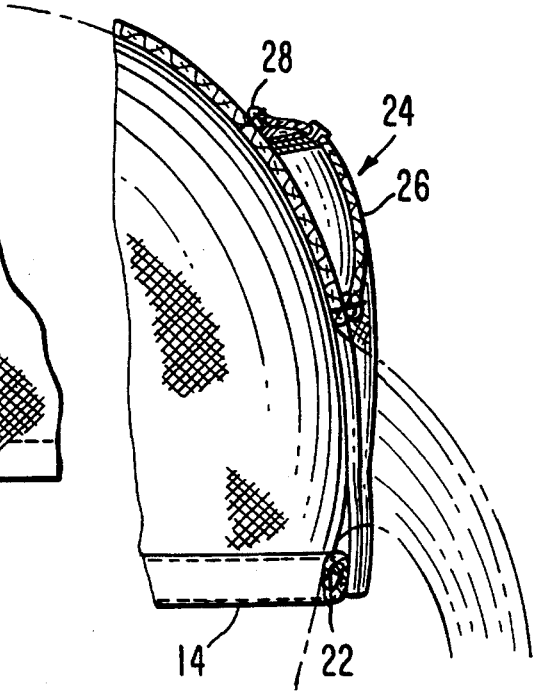
FIG. 3 is an elevation view taken along line 3—3 of FIG. 2.

Referring initially to FIGS. 1, 2, 3 and 5, a cap 10 constructed in accordance with the present invention may include a head-covering portion 12 having a lower edge 14 to which a forwardly-extending brim 16 is affixed. The cap may be manufactured in a manner known in the art, such as by the utilization of a plurality of generally triangular-shaped gores 18 stitched together along adjacent edges to form a generally hemispherical construction.

A generally curved section is removed from the rear portion of the head covering portion 12 adjacent the lower edge 14, yielding downwardly directed a slot or opening 20 bounded by a pair of opposed lower edge ends. The opposed edge ends are joined by a length of an elastic material 22 which, in its non-stretched state, generally reproduces the length of the lower edge 14 removed to form the opening. With the circumference of the lower edge being chosen to be slightly less than that of the forehead region upon which the cap is to be worn, the elastic band provides a measure of size adjustment and serves to maintain the cap firmly but gently in place on the head.

The pocket 24 is preferably located at the rear of the head covering portion, and is formed from a pair of layered elements joined about their common periphery to form a receptacle pocket therebetween. In particular, an outwardly-lying sheet layer 26, typically a fabric material whose exterior dimensions generally define the extent and shape of the pocket, is sewn about its peripheral edge 28 to the underlying corresponding portion of the head covering portion 12 material. As shown in the Figures, the pocket preferably extends from the opposed points of connection between the elastic band 22 and lower edge 14 upwardly about the opening 20 and outwardly, terminating in a generally arcuate top edge 30. The layer 26 may be of a contrasting pattern or material or otherwise chosen for desired effects. A slot is formed in one of the layers, preferably the overlying fabric layer 26, zipper 32 being installed thereon in a known manner to provide a resealable means for access into the pocket interior.

The seam line formed about the periphery of the opening 20 is preferably flat, but alternatively may be formed in a gathered manner with an elastic band being incorporated therein, whereby at least a portion of the pocket edge 34 is expandable in a manner analogous to the operation of the elastic band 22. The incorporation of the elastic band therein to achieve such results may be in any manner as known in the art. Such a construction may have enhanced utility when the hat is worn by one having long hair, which may be formed into a ponytail and passed through the opening 20, the size of the opening accommodating the hair mass passing therethrough as a result of the flexing of a substantial portion of the circumference of the opening.

Figure 4:
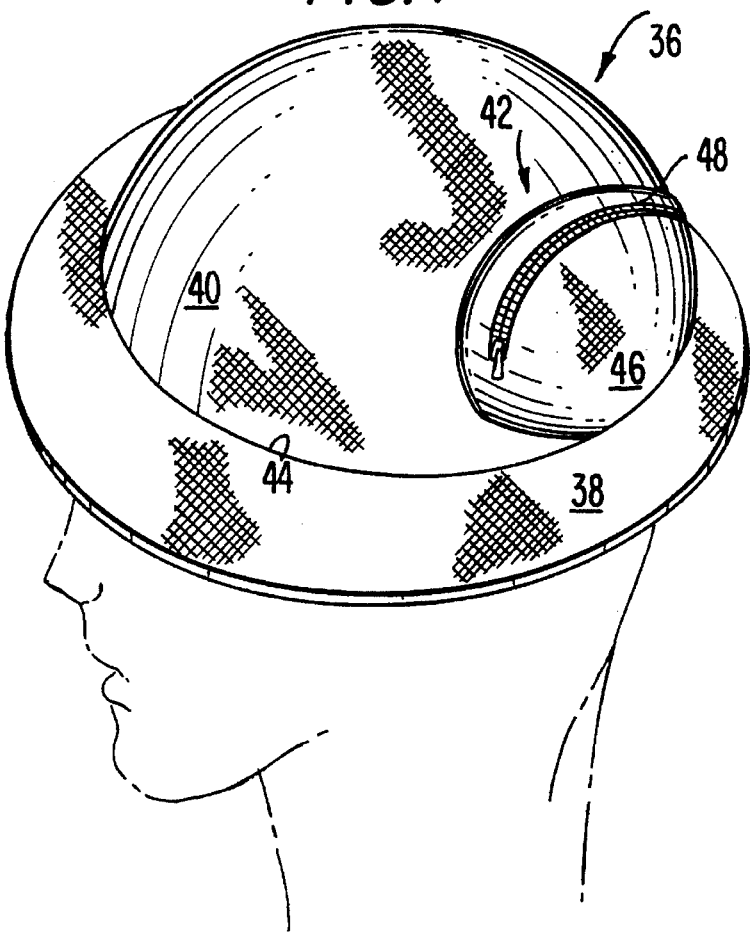
FIG. 4 is a perspective view of a second embodiment of the invention incorporated into a head covering having a full brim therearound.
Figure 5:
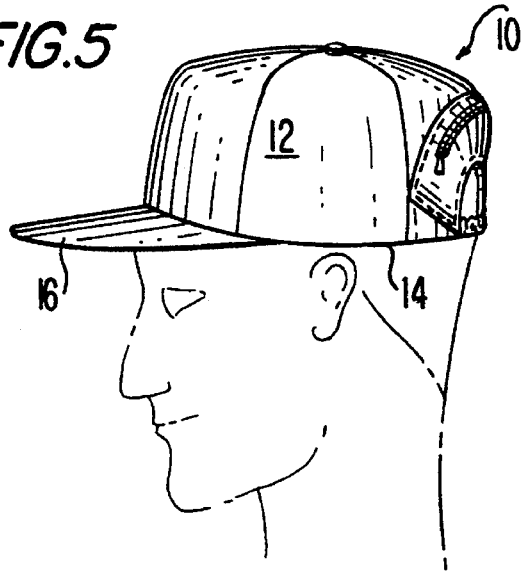
FIG. 5 is a side perspective view of the cap of FIG. 1.

A second embodiment of the present invention is set forth in FIG. 4. As presented therein, the cap 36 comprises a full, encircling brim 38 about the lower edge of the head covering portion 40. In this embodiment the pocket 42 has a lower edge defined by the line of intersection 44 between the head covering portion 40 and the brim 38 but otherwise is of analogous construction to that set forth above, in that an overlying fabric layer 46 is cut and dimensioned to define the overall pocket dimensions and is stitched to the head covering portion 40 about its periphery. The zipper 48 is again installed in a manner to allow controlled access to the pocket interior.

As presented herein, the cap construction of the present invention provides means for carrying small items in a cap construction of economical and fashionable construction.

I claim:

1. A pocketed cap, comprising a head covering portion terminating at a peripheral lower edge; a piece of sheet material having a lower edge, a pair of outwardly-directed side edges, and an arcuate top edge overlying a minor portion of said head covering portion, said lower edge of said overlying sheet being aligned with said lower edge of said head covering portion, the remaining periphery of said overlying sheet being attached to said head covering portion to form a pocket therebetween, said pocket being operable while said cap is worn by a user; and means located upon said overlying sheet proximate said arcuate top edge for controlled access to the interior of said pocket from the exterior of said cap.

2. The cap of claim 1, wherein said pocket is located on a rear surface of said cap.

3. The cap of claim 1, wherein said head covering portion lower edge includes an upwardly-extending loop-like portion, said pocket being located upon said head covering portion about said loop.

4. The cap of claim 1, wherein said means for controlled access is a zipper.

5. The cap of claim 4, wherein said zipper is located on said overlying sheet.

6. The cap of claim 1, wherein said head covering includes a rearwardly-located, downwardly-extending removed section adjacent said lower edge, and forming a pair of edge ends, an elastic band extending between said edge ends, said overlying sheet being located upon said head covering portion in the region about said removed section.

* * * * *